United States Patent [19]

Stephens

[11] 3,995,333

[45] Dec. 7, 1976

[54] DRAIN STOPPER

[75] Inventor: James B. Stephens, La Crescenta, Calif.

[73] Assignee: Graning Company, El Monte, Calif.

[22] Filed: Oct. 20, 1975

[21] Appl. No.: 623,827

[52] U.S. Cl. ..... 4/286; 4/295

[51] Int. Cl.[2] ..... A47K 1/14

[58] Field of Search ..... 4/286, 287, 295, 290, 4/292, 293; 267/1; 138/89, 90

[56] References Cited

UNITED STATES PATENTS

| | | | |
|---|---|---|---|
| 2,487,635 | 11/1949 | Carpenter | 4/295 |
| 3,261,598 | 7/1966 | Jones | 267/1 |
| 3,366,980 | 2/1968 | Petursson | 4/295 |
| 3,380,081 | 4/1968 | Eilertson et al. | 4/295 |
| 3,428,295 | 2/1969 | Downey et al. | 4/295 X |
| 3,771,177 | 11/1973 | Rogers et al. | 4/287 |
| 3,949,433 | 4/1976 | Liou | 4/295 |

FOREIGN PATENTS OR APPLICATIONS

| | | | |
|---|---|---|---|
| 705,565 | 3/1965 | Canada | 4/295 |

OTHER PUBLICATIONS

NASA Tech. Brief (66–10297)8–1966.

*Primary Examiner*—Henry K. Artis
*Attorney, Agent, or Firm*—Donald D. Mon

[57] ABSTRACT

A closure for a drain port in a receptacle such as a bath tub or sink. The closure includes a base member for attachment to the receptacle. It includes a fulcrum which engages one side of a bi-stable disc spring. A pair of actuators are situated on the opposite side of the spring, and contact it respectively radially inwardly and outwardly from the fulcrum. The spring can be moved by the actuators to assume a respective one of its two stable configurations. The spring, when in one configuration, permits a seal to bear against a peripheral surface around the drain port to close it. When in the other configuration, it causes the seal to move away from the peripheral surface and open the drain port.

15 Claims, 9 Drawing Figures

DRAIN STOPPER

This invention relates to a closure for a drain port in a receptacle such as a bathtub or a sink.

Conventional closures for bathtubs and sinks involve substantial linkages which can get out of repair. Recently, efforts have been made to provide replacement closures which can be inserted directly into the drain port, and can be operated by pushing and/or pulling on them. These replacement closures have limitations of their own.

It is an object of this invention to provide a closure for the drain port of a receptacle which can readily be installed in the drain port, and which requires only a minimum number of parts, all of which are simple and reliable.

It is another object of this invention to provide a closure which can either be opened or closed by a force exerted on the same side of the closure and in the same direction, for example downwardly.

A closure according to this invention includes a base member to support the closure at the drain port. The base member includes a fulcrum which faces away from the drain port. A bi-stable disc spring has two stable configurations, with the axial alignment of the center relative to the rim being different in each of them. The spring can be pressed against the fulcrum to change it from one configuration to the other by a first and a second actuator. A peripheral seal means is carried by the outermost one of these actuators. The seal will bear against a surface surrounding the drain port and close it when the spring is in one of its configurations, and will move away from the surface when the spring is in the other of its configurations.

According to a preferred but optional feature of the invention, the disc spring has a central orifice and a plurality of waves adjacent to it. The waves reduce the axial force needed to change the configuration of the spring.

The above and other features of this invention will be fully understood from the following detailed description and the accompanying drawings, in which.

Figure 1:
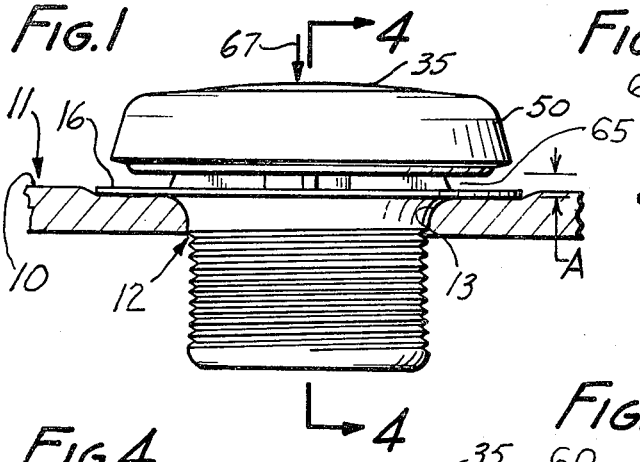
FIG. 1 is a side elevation of a closure according to the invention in its open configuration.

FIG. 1 shows boundary 10 of a receptacle 11. In the illustration, the receptacle is a bathtub and the boundary is its bottom. In accordance with common construction, a spud 12 is installed in the drain port 13 of the receptacle. The spud is hereinafter regarded as a part of the receptacle itself, and often is semi-permanently installed in it. It is rarely, if ever, removed or replaced. The spud includes a central port 14 through which water drains. Port 14 is referred to as part of drain port 13. The spud usually includes a web 15 at the bottom of the port, and a peripheral flat surface 16 around the drain port. Port 14 is bounded by a cylindrical wall 17.

Figure 6:
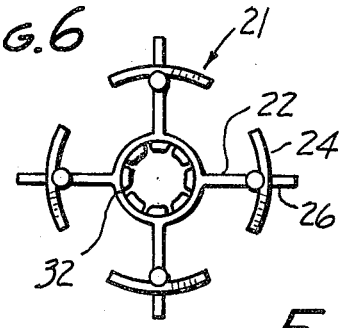
FIG. 6 is a bottom view of part of FIG. 4.

An actuator 20 according to this invention includes a base member 21 for attachment to the receptacle. In the example shown, the base member includes a plurality of ribs 22 which project radially outward relative to a central axis 23 of the closure. For universality and reliability of fit, a flexible plate 24 is cast integrally with each of the ribs. The base member may readily be made of a castable, stiffly flexible, plastic material such as Delrin. Plates 24 can bend to the curvature of wall 17, and the ribs 22 can deflect to accommodate to the diameter of wall 17. Accordingly, this base member will fit snugly in ports of various diameters. In FIG. 6 the base member is shown in its relaxed condition, outside of a drain port.

Care will be taken to utilize a plastic material which will not soften excessively in the temperatures to be encountered. The base member will then remain sufficiently rigid to perform its function.

The base member includes at least one, but preferably a plurality of fulcrums 25. Four are shown in the example. The fulcrums are located outwardly from the central axis and are supported as part of a respective one of four flanges 26, each of which is continuous with a respective rib 22. The flange bears against surface 16. This establishes the height of the fulcrum relative to surface 16. The fulcrum is the outer upper corner of the flange. The innermost upper surface adjacent to the fulcrum is sometimes referred to as a "stop member" 27.

The base member also includes a passage 30 bounded by peripheral wall 31, which tapers toward its bottom end. Slits 32 at the bottom end of the passage form fingers 33.

The base member is installed in the drain port by shoving it in until the flanges 26 bear against surface 16. The remainder of the closure then can be mounted to the base member. The said remainder includes a first actuator 35 that has a closed push surface 38 at the top of a generally cylindrical portion 39. Portion 39 is bounded by a sidewall **39*a*. A radially extending flange 40 projects from the bottom of sidewall 39*a*. A central post 41 extends axially downward from the cylindrical portion. A convenient post construction is cruciform in cross-section. This provides four edges 42 which engage the inside of wall 31 and are sometimes engaged by fingers 33. These edges and wall 31** can be tapered inwardly toward the bottom so as to make a progressively tighter fit ("grip") as the central post moves downward.

At least one contactor *re*, but preferably four of them, are formed as downwardly directed fingers depending from the cylindrical portion. These are disposed radially inward from the fulcrum when the device is assembled.

A second actuator 50 concentrically surrounds the first actuator. It includes an opening 51 which makes a close sliding fit around cylindrical sidewall 39a. Flange 40 extends radially outwardly beyond the wall of opening 51. Actuator 50 includes a skirt 52 which depends downwardly. A bearing surface 53 comprises a peripheral shoulder on the inside of the skirt. It is convenient for this shoulder to be continuous, although this is not necessary. Surface 53 is sometimes called a "contactor" because like contactor 45 it is adapted to bear downwardly on the spring to actuate it.

A seal means 55 is made from a stiffly flexible elastomeric material. It includes a downwardly projecting lip 56. The seal means is bonded to the inside of the skirt and projects below it. It will contact surface 16 when the closure is in its closed configuration.

Figure 2:
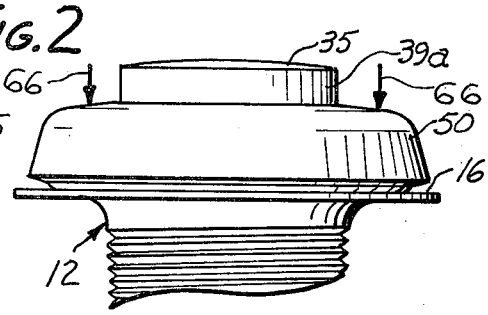
FIG. 2 is a fragmentary view similar to FIG. 1, showing the closure in its closed configuration.

It is an object of this invention to move seal means 55 upwardly to the position shown in FIG. 1 for opening the drain port, and to move it downwardly to the position shown in FIG. 2 for closing the drain port. It is a feature of this invention that both opening and closing movements can be caused by forces exerted in the same direction and on the same side of the closure, namely downwardly on the top of it.

Figure 7:
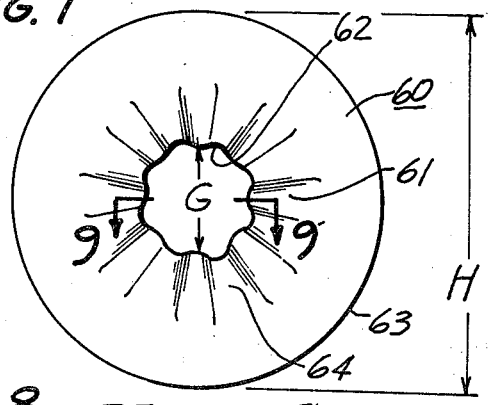
FIG. 7 is a plan view of a bi-stable disc spring used in the invention.
Figure 8:
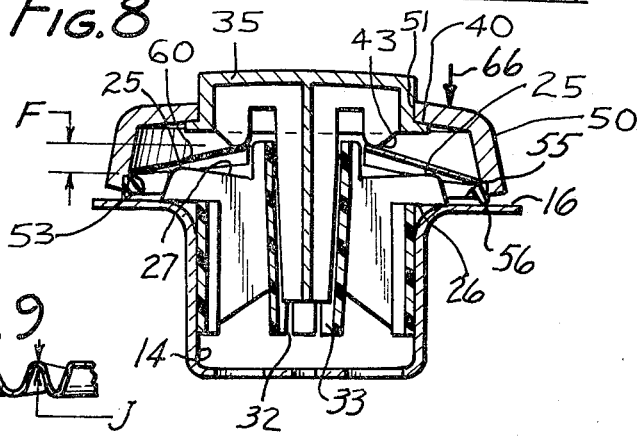
FIG. 8 is a view similar to FIG. 4 with the closure in its closed, instead of in its open, configuration.
Figure 9:
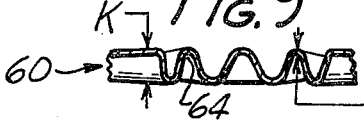
FIG. 9 is a fragmentary section taken at line 9—9 in FIG. 7.

It is a feature of this invention that the closure will inherently retain its selected configuration. This is accomplished by the bi-stable disc spring 60 shown in FIGS. 4, 7 and 8. This disc spring is of the type commonly known as a "Belleville" spring. It has a "snap-over" capability. Such springs are well known in the art. The spring selected should have two stable configurations in which the axial location of the inside and outside of the disc are different. One such configuration is shown in FIG. 1 where the conicity of the spring is concave upwardly, and another is shown in FIG. 8 where the conicity is concave downwardly. By "conicity" is meant the generally tapered configuration. However, it does not mean a true frustum of a cone, although it could.

It has been found useful to lower the forces required for actuation when the spring is made of metal, such as stainless steel, by forming waves 61 in the spring which radiate outwardly from a central aperture 62. These terminate short of the outer rim 63 of the spring. The outer rim is preferably a smooth circle so that it can continuously be engaged by the bearing surface 53. When the spring is made of plastic, it can be a true frustum of a cone, because the forces needed to change the configuration of a plastic belleville washer are not excessive.

Figure 4:
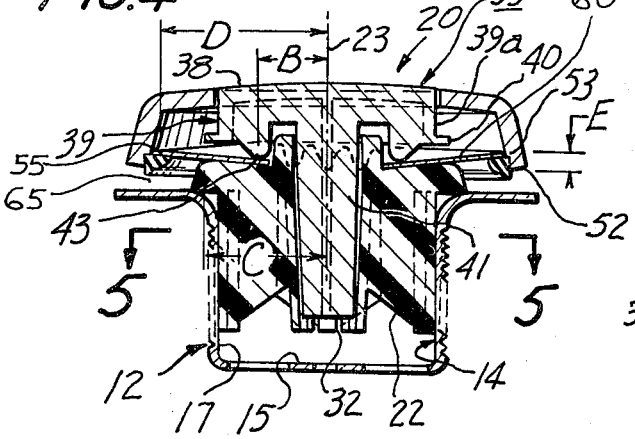
FIG. 4 is an axial cross-section taken at line 4—4 of FIG. 1.
Figure 3:
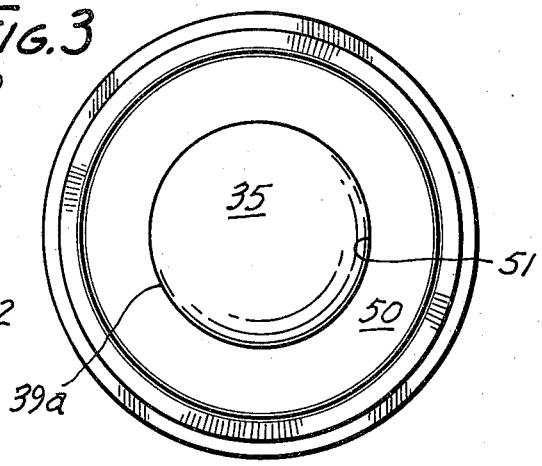
FIG. 3 is a top view of FIG. 1.
Figure 5:
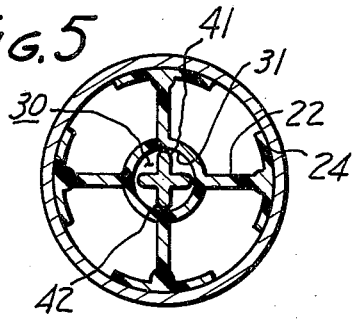
FIG. 5 is a cross-section taken at line 5—5 of FIG. 4.

FIGS. 4 and 8 show that, relative to the central axis, the contactor or contactors on the first actuator 35 are on opposite sides of the fulcrum from the bearing surface 53. Therefore, downward forces on one actuator will tend to move the other actuator in the upward direction, tilting around the fulcrum. In FIG. 4, wherein the closure is in the open configuration, the root 64 of the wave bears against the stop member 27. This limits the downwardly deforming force which can be exerted on the spring and protects it from abuse.

In FIG. 8 flange 40 is shown bearing against the under surface of the actuator 50 adjacent to opening 51. This forms a close fit between the two. Leakage past this joint while in the closed configuration is quite small. Should this constitute an insufficient seal, then a sliding flexible seal may be placed between the wall 39a and the wall of opening 51. The construction shown with clearances of a few thousandths of an inch has been found to be quite adequate for practical bathtub stoppers. There should also be a small clearance between the fulcrum and the bottom of the spring in the open configuration of FIG. 8. With such a clearance, the first actuator is held up against the second actuator, and the seal can rest on surface 16 without interference from the fulcrum.

The operation of the closure should be evident from the foregoing. All that is necessary to install the closure is to press the base member into the spud and then, with the actuators and disc spring already assembled together as a unit, push the central post of the first actuator into the passage 30.

The tendency of the closure when installed by pressing down on the first contactor is to assume the configuration of FIG. 4, because the first contactors will have pressed the inner edge of the disc spring downwardly in opposition to the upward force exerted on the fulcrum, and the disc spring will snap over to the condition shown in FIG. 4. The post will have moved down to form a light grip with wall 31 and with fingers 33. The device is stable in the position illustrated. Water in the receptacle will drain through the spacing 65 between the seal means 55 and surface 16.

When the closure is to be closed, downward force shown by arrows 66 is exerted on the top of the second (outer) actuator. Because of the engagement of the bearing surface 53 against the outer rim of the disc and the opposition of the fulcrum, the disc will be snapped over to the configuration shown in FIG. 8. The spring will press the contactors, and therefore the first actuator, upwardly and cause flange 40 to make a fluid sealing fit with the under surface of the second actuator, and that the seal means contacts the surface 16. However, the spring preferably does not bear against the fulcrum, because this might tend to hold the seal means off the peripheral surface.

Instead, a small clearance exists between the fulcrum and the spring in the closed configuration. Even though there is a potential leakage path from inside the first actuator through aperture 62 and past the ribs in the member, the closure is adequate. Tests made on the closure shown with a full bathtub indicate a leakage of less than one gallon per hour. This is a practical and acceptable rate of leakage.

When waves are provided in the spring, the contactors on the first actuator are arranged so as to fit in the trough of a wave on top of the spring, and the fulcrums are arranged to fit into a trough underneath.

It will be observed that the central post 41 has raised in the passage 30 and is no longer held by the grip when the closure is open as in FIG. 8, but this is immaterial because, with the device in the condition shown, it is either weighted down by the pressure of water above it, or is not relied on for sealing if the tub is empty.

When the closure is again to be opened, force is exerted on the top of the first actuator shown by arrows 67 to restore the device to the configuration of FIGS. 1 and 4.

The Figs. are substantially to scale. A few representative dimensions, in inches, around which a practical stopper can be and has been designed are as follows, with reference to the drawings:

| | |
|---|---|
| Gap A (65) when stopper is open: | 0.10 |
| Nominal distance B of contactor from central axis: | 0.45 |
| Nominal distance C of fulcrum from central axis: | 0.90 |
| Outside radius D of disc spring: | 1.25 |
| Axial spacing E between outside rim of disc spring and the edge of the inside aperture in open configuration: | 0.25 |
| Axial spacing F between outside rim of disc spring and the edge of the inside aperture in closed configuration: | 0.25 |
| Nominal diameter G of inside aperture of disc spring: | 0.75 |
| Outside diameter H of rim of disc spring: | 2.50 |
| Thickness J of disc spring: | 0.008 |

-continued

| | |
|---|---|
| Depth K of waves of disc spring (on both sides): | 0.15 |

The disc spring can conveniently be made from 302 CRES stainless steel, dead soft. It can instead be made of any suitable material, including plastics as well as metals. The actuators can be made of suitable plastics such as Delrin or polypropylene.

The device shown is a practical and rugged device. Each part is made of the material believed to be optimum for its respective purpose.

Obviously various of the parts could be combined with one another, such as by being cast together. For example, if a plastic spring were used it could be combined with one or both of the actuators in a single piece. Such combinations are within the scope of this invention.

This invention thereby provides a readily installed, simple and durable closure which can both be opened and closed by downward forces on the top of the closure.

This invention is not to be limited by the embodiment shown in the drawings and described in the description, which is given by way of example and not of limitation, but only in accordance with the scope of the appended claims.

I claim:

1. A closure for a drain port that passes through a boundary of a receptacle, comprising: a base member to support the closure at the drain port; a fulcrum on the base member facing away from the drain port when the base member is installed; a bi-stable disc spring having two stable configurations; a first actuator; a second actuator; a contactor on each actuator, the contactor on the first actuator being on the opposite side of the fulcrum from the contactor on the other actuator viewed in a radial section, said actuators both being on the same side of the spring, whereby pressing one actuator against the spring and the spring against the fulcrum moves the other actuator in the opposite direction and changes the configuration of the spring; and seal means carried by the outermost of the actuators so disposed and arranged as to bear against a surface surrounding the drain port and to close the drain port in a first spring configuration, and to move away from it and open the drain port in the second spring configuration.

2. A closure according to claim 1 in which the actuators together form a leak-resistant cover inside the seal means, at least when the spring is in its first configuration.

3. A closure according to claim 1 which has a central axis, in which a plurality of said fulcrums are disposed around the central axis at substantially equal radial distances therefrom.

4. A closure according to claim 3 in which a plurality of said contactors is provided on each actuator, the contactors respective to each actuator being at a substantially equal radial distance from the central axis.

5. A closure according to claim 1 in which the base member includes a stop member against which the spring bears when in the second configuration.

6. A closure according to claim 1 in which the actuator whose actuation tends to open the closure fits within an aperture through the other actuator, and includes a flange which bears against the said other actuator when the closure is closed.

7. A closure according to claim 6 in which the flange makes a close fit with the said other actuator when the closure is closed.

8. A closure according to claim 6 in which the base member includes a stop member against which the spring bears when in the second configuration.

9. A closure according to claim 8 in which the flange makes a close fit with the said other actuator when the closure is closed.

10. A closure according to claim 1 in which the base member includes a plurality of ribs which engage the drain port, and a central opening, said central opening receiving and guiding one of said actuators.

11. A closure according to claim 10 in which the wall of the central opening makes a light sliding grip with a portion of one of the actuators, whereby to tend to hold the closure to the base member at least in the first configuration.

12. A closure according to claim 11 in which the said wall is slotted to create fingers which make said grip.

13. A closure according to claim 1 in which the spring includes a central aperture and a plurality of radially-extending waves radiating from said aperture, the fulcrum and the contactor of one of the actuators engaging the spring at the base of respective waves.

14. A closure according to claim 1 in which the spring includes an outer circular edge, and in which the contactor of one of said actuators is a surface engaging said edge.

15. A closure according to claim 1 in which the actuators are symmetrical bodies.

* * * * *

UNITED STATES PATENT OFFICE

CERTIFICATE OF CORRECTION

Patent No. 3,995,333 Dated December 7, 1976

Inventor(s) JAMES B. STEPHENS

It is certified that error appears in the above-identified patent and that said Letters Patent are hereby corrected as shown below:

| | |
|---|---|
| Col. 2, line 53 | "re" should read --43-- |
| Col. 2, line 67 | "45" should read --43-- |
| Col. 3, line 22 | "axial location" should read --relative axial locations-- |

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*